US011905796B2

(12) United States Patent
Kuliev et al.

(10) Patent No.: US 11,905,796 B2
(45) Date of Patent: Feb. 20, 2024

(54) DOWNHOLE TOOL INTERFACE

(71) Applicant: Schlumberger Technology Corporation, Sugar Land, TX (US)

(72) Inventors: Almaz Kuliev, Cheltenham (GB); Aaron Barnes, Cheltenham (GB); Neil Cooper, Quedgeley (GB); Nicholas Masson, Gloucester (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/816,542

(22) Filed: Aug. 1, 2022

(65) Prior Publication Data

US 2023/0039508 A1 Feb. 9, 2023

Related U.S. Application Data

(60) Provisional application No. 63/229,081, filed on Aug. 4, 2021.

(51) Int. Cl.

| | |
|---|---|
| ***E21B 41/00*** | (2006.01) |
| ***E21B 47/26*** | (2012.01) |
| ***E21B 47/13*** | (2012.01) |

(52) U.S. Cl.

CPC ..... *E21B 41/00* (2013.01); *E21B 41/0085* (2013.01); *E21B 47/13* (2020.05); *E21B 47/26* (2020.05)

(58) Field of Classification Search

CPC ..... E21B 47/26; E21B 41/0085; E21B 47/13; E21B 41/00; E21B 47/01

See application file for complete search history.

(56) References Cited

U.S. PATENT DOCUMENTS

| | | | | |
|---|---|---|---|---|
| 4,928,088 | A * | 5/1990 | Jorion | G08C 23/00 340/854.7 |
| 10,196,893 | B2 * | 2/2019 | Nakayama | G01V 11/002 |
| 2003/0218547 | A1 * | 11/2003 | Smits | E21B 47/26 340/854.8 |
| 2005/0145416 | A1 * | 7/2005 | Reed | E21B 47/26 175/40 |
| 2010/0133006 | A1 * | 6/2010 | Shakra | E21B 47/12 340/855.8 |
| 2018/0209235 | A1 * | 7/2018 | Creighton | E21B 47/135 |
| 2018/0252095 | A1 * | 9/2018 | Pridat | E21B 47/13 |
| 2022/0034218 | A1 * | 2/2022 | Evans | E21B 47/13 |

* cited by examiner

*Primary Examiner* — Brad Harcourt
(74) *Attorney, Agent, or Firm* — Jeffrey D. Frantz

(57) ABSTRACT

A downhole tool interface is connected to a downhole tool at a surface location. The downhole tool interface retrieves downhole information and wirelessly transmits the downhole information to a remote computing device. The downhole tool interface remains connected to the downhole tool during storage and/or transportation. The downhole tool interface collects status information to transmit to a remote computing device, allowing a drilling operator to better understand the conditions during storage and/or transportation.

20 Claims, 5 Drawing Sheets

DOWNHOLE TOOL INTERFACE

CROSS-REFERENCE TO RELATED APPLICATIONS

This application claims the benefit of, and priority to, U.S. Patent Application No. 63/229,081, filed Aug. 4, 2021 and titled "Downhole Tool Interface", which application is expressly incorporated herein by this reference in its entirety.

BACKGROUND

Downhole drilling is the process of drilling a wellbore to access subterranean formations. Access to such formations may be desirable for various reasons, including the presence of minerals, hydrocarbons, and other materials of interest within the formations. Drilling can involve complicated processes where downhole tools undergo a variety of conditions and move through various types of formations. Thus, wellbores may be thousands of feet deep, and can be drilled or accessed with specialized tools to perform tasks downhole. Many of these specialized tools include sensors or other data collection elements that collect downhole information about the formation, downhole environment, or tool performance. Downhole information may be stored on a downhole tool for later retrieval, or may be transmitted to the surface in near real time using various telemetry of communication methods.

SUMMARY

In some embodiments, a downhole tool interface includes an interface communication port. The interface communication port is configured to connect to a tool communication port on a downhole tool. The downhole tool interface is connected to the downhole tool while the downhole tool is at a surface location. In some embodiments, the downhole tool interface includes local data storage that is configured to store downhole information retrieved from the interface communication port. In some embodiments, the downhole tool interface includes a wireless communication system configured to communicate with a remote location. In some embodiments, the downhole tool interface includes a status sensor that senses the status of the downhole tool interface and/or the downhole tool during storage and/or transportation of the downhole tool.

In some embodiments, a method for collecting data from a downhole tool includes connecting a downhole tool interface to the downhole tool. The data is retrieved from the downhole tool over a communication port. The data is stored on local storage of the downhole tool interface and transmitted wirelessly to a remote computing device.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Figure 1:
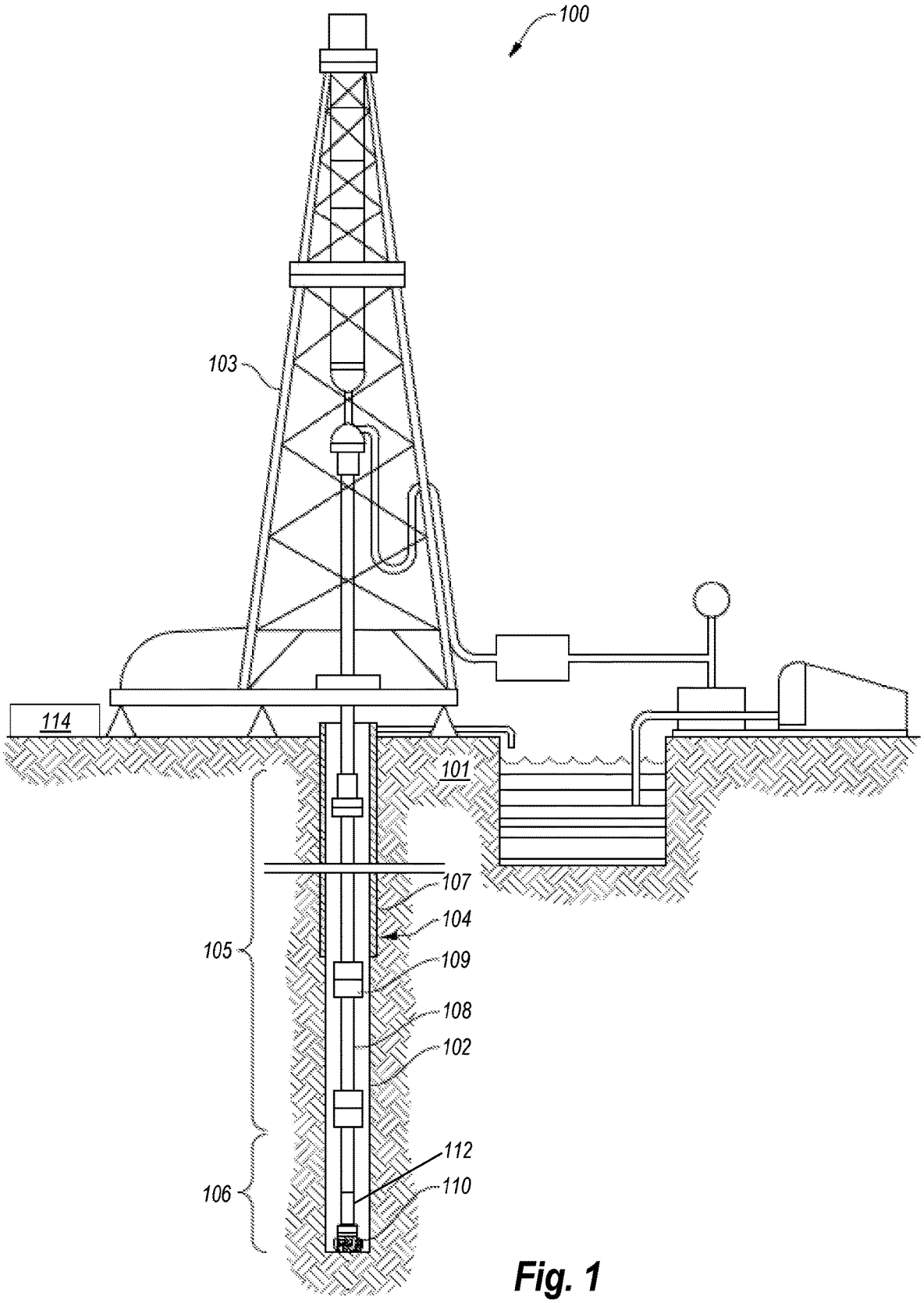
FIG. 1 is a representation of a drilling system, according to at least one embodiment of the present disclosure.

This disclosure generally relates to devices, systems, and methods for a downhole tool interface. A downhole tool interface may connect to a downhole tool when the downhole tool is on or near the surface. The downhole tool interface may be able to communicate with the downhole tool, which can include retrieving downhole information from, and providing instructions or other information to, the downhole tool. A wireless communication system on the downhole tool interface may wirelessly transmit the collected information and/or receive instructions from a remote device, such as a local drill site server or a cloud server. The downhole tool interface may be designed to work in hazardous environments, such as explosive environments due to the presence of hydrocarbons at drill sites. In some embodiments, the downhole tool interface may include tracking and status sensors to help track the location and/or shipping and handling conditions of the downhole tool.

In accordance with embodiments of the present disclosure, a downhole tool interface may help to reduce the amount of downtime a downhole tool experiences. For example, a downhole tool may store a large amount of drilling or other downhole data that may not have been able to be transmitted to the surface during operation. Retrieving this downhole information may occur at a surface location, potentially while the downhole tool is connected to a drill string or once the downhole tool has been disconnected from the drill string. Furthermore, an engineer or other technician may be on site to oversee the retrieval of this information using specialized connections and other communication elements. Downhole tool interfaces of the present disclosure may be generic to multiple downhole tools and connected to the downhole tool by a drilling operator, or may automatically connect (i.e., without user intervention), such as when the devices are in close proximity. The downhole tool interface may then transmit the retrieved downhole information during and/or after the downhole information is collected. This may reduce the amount of time spent by an engineer or other human operator on the surface retrieving the information.

In some embodiments, tracking sensors on the downhole tool interface may help improve a drilling operator's inventory management. The downhole tool interface may remain connected to a downhole tool between different rig sites. A GPS or other location sensor may track the location of the downhole tool during transit. In this manner, the drilling operator may always know where a particular downhole tool is located, thereby reducing the chance that a downhole tool is lost or misplaced between jobs.

Status sensors may help a drilling operator to determine the shipping and handling conditions of the downhole tool. On occasion, a downhole tool may be damaged during loading onto a truck, unloading off of a truck, transportation on the truck, and at other times during shipping and handling of the downhole tool. The downhole tool interface may include status sensors configured to sense the status of the downhole tool while the downhole tool is at a surface location. The status sensors may include any suitable type of sensors, such as accelerometers, vibration sensors, impact sensors, temperature sensors, moisture sensors, and so forth. If a downhole tool is damaged or otherwise not performing as expected, the drilling operator may analyze the status sensors to help determine the cause of the damage to the downhole tool. This may help to develop new transportation protocols and/or determine liability for damage to a downhole tool.

FIG. 1 shows one example of a downhole system. For convenience, the illustrated downhole system is described as drilling system 100 for drilling an earth formation 101 to form a wellbore 102 at a surface location; however, the drilling system 100 is illustrative only, and a downhole system may include wireline, coiled tubing, production, or other types of downhole systems that may not be used specifically for drilling the wellbore 102. In the drilling system 100, a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power to the BHA 106. The rotational power may be provided in the form of rotation at the drill rig 103, or fluid flow that can cause a downhole motor to rotate the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, for lifting cuttings out of the wellbore 102 as it is being drilled, and for providing structural integrity/stability to the wellbore 102.

The BHA 106 may include one or more downhole tools 112. A downhole tool 112 may be any instrument, tool, cutting device, any other tool, and combinations thereof, that is used in a wellbore, such as the bit 110 or other components. An example BHA 106 may include additional or other downhole tools 112 or components (e.g., coupled between to the drill string 105 and the bit 110). Examples of additional BHA components or other downhole tools 112 include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 and/or downhole tools may further include a rotary steerable system ("RSS"). The RSS may include directional drilling tools that change a direction of the bit 110, and thereby the trajectory of the wellbore. Optionally, at least a portion of the RSS may maintain a geostationary position relative to an absolute reference frame that can include one or more of gravity, magnetic north, or true north. Using measurements obtained with the geostationary position, the RSS may locate the bit 110, change the course of the bit 110, and direct the directional drilling tools on a projected trajectory.

Some or all of the downhole tools 112 of the BHA 106 include one or more sensors or other elements that collect downhole information. For example, the downhole information may include survey information, such as directional information (e.g., azimuth and inclination), geological information, optical images, electrical conductivity measurements, seismic measurements, acoustic measurements, nuclear magnetic resonance ("NMR") measurements, any other type of survey information, and combinations thereof. In some examples, the downhole information may include drilling information, such as weight on bit ("WOB"), downhole or surface torque, drilling fluid pressure, drilling fluid flow rate, bit 110 and/or drill string 105 rotational rate, any other downhole information, and combinations thereof. In some examples, the downhole information may include downhole tool information, such as power generation, power usage, actuation information, communication information (e.g., pressure pulse communication, wireless communication, electromagnetic down/uplink), cutting element or blade force information, any other downhole tool information, and combinations thereof. Where the downhole system is something other than a drilling system, other types of downhole information may be captured by one or more sensors. Illustrative information can include formation information (e.g., porosity, hardness, etc.), fluid production rate, fracture/fault location and characteristics, and the like.

The downhole tools 112 and/or BHA 106 components are connected to the drill string 105 at the drill rig 103. In some situations, one or more of the drill rig 103, the collar, or portions of the area surrounding the drill rig 103 may be an explosive or other type of hazardous environment. An explosive environment may be an environment in which the possibility for a fire or explosion from a mixture of flammable material (including liquids and gases) is present. For example, many wellbores produce hydrocarbons. A portion of the hydrocarbons may be released at the surface, and may catch fire or explode in the presence of an ignition source. To mitigate the risk of a fire or explosion, many national jurisdictions and private companies have rules, regulations, or policies that are devoted to producing safe electronics. In some cases, electronics are required to be encased in a housing that makes it difficult for a spark to be released and/or for a fire or explosion to propagate. In some embodiments, the housing contains all the electronic components of the downhole tool interface, such as the local data storage, the wireless communication system, the status sensors, and so forth. In some embodiments, an interface connector may extend out of the housing.

In accordance with embodiments of the present disclosure, a downhole tool interface 114 may be connected to the downhole tool 112 within the hazardous environment. The downhole tool interface 114 may be designed, fabricated, or manufactured to comply with the various jurisdictional and/or corporate hazardous environment regulations and policies. In this manner, the downhole tool interface 114 may be connected to the downhole tool 112 while in the hazardous environment. This may allow the downhole tool interface 114 to remain connected to the downhole tool 112 until or even while the downhole tool 112 is connected to the drill string 105. Furthermore, this may allow the downhole tool interface 114 to be connected to the downhole tool 112 as soon as the downhole tool 112 is separated from the drill string 105. Put another way, the downhole tool interface 114 may be connected to and disconnected from the downhole tool 112 at the drill rig 103. This may help to reduce the chance of the downhole tool 112 being shipped or handled while disconnected from the downhole tool interface 114. In this manner, a drilling operator may stay connected to and/or be able to track the location and status of the downhole tool 112. This may help to reduce the chance of losing track of the downhole tool 112, thereby improving the utilization of the downhole tool 112.

The downhole tool interface 114 may be connected to the downhole tool 112 at a surface location. For example, the downhole tool interface 114 may be connected to the downhole tool 112 at the drill rig 103. In some examples, the downhole tool interface 114 may be connected to the downhole tool 112 while the downhole tool 112 is suspended from the kelly or at any other location on the drill rig 103. In some embodiments, the downhole tool interface 114 may become or remain connected to the downhole tool 112 at any other surface location, including a lay-down yard, a warehouse, a transport truck, any other surface location, and combinations thereof.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
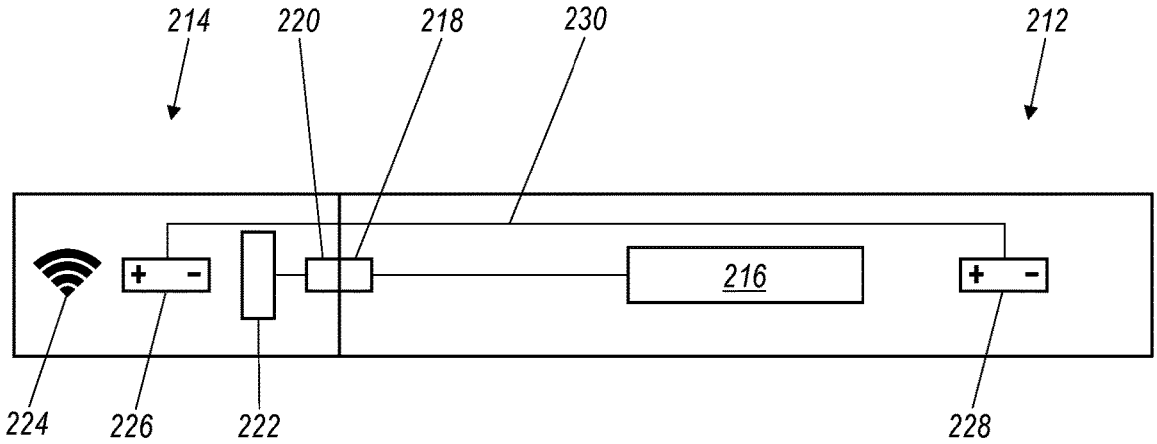
FIG. 2 is a representation of a downhole tool interface connected to a downhole tool, according to at least one embodiment of the present disclosure.

FIG. 2 is a representation of a downhole tool interface 214 connected to a downhole tool 212, according to at least one embodiment of the present disclosure. The downhole tool 212 may be any downhole tool discussed or apparent from the discussion herein. The downhole tool 212 may have collected downhole information in a downhole tool memory 216. The downhole tool memory 216 may be accessed through a tool communication port 218. The downhole tool interface 214 may include an interface communication port 220. The interface communication port 220 may connect to the tool communication port 218. The downhole tool interface 214 may retrieve the data stored on the downhole tool memory 216 through the tool communication port 218.

The tool communication port 218 may be any type of communication port. For example, the tool communication port 218 may include a physical or wired port, such as a plug, an electrical contact, any other physical port, and combinations thereof. In some examples, the tool communication port 218 may include a wireless communication port. For example, the tool communication port 218 may include near field communication ("NFC") ports that communicates wirelessly under a wireless communication protocol, such as Wi-Fi, Bluetooth, Zigbee, Z-wave, 6LowPAN, Thread, Sigfox, Neul, LoRaWAN, infrared, or other wireless communication protocol, and combinations thereof. In some examples, the tool communication port 218 may include a combination of physical or wired and wireless ports.

The interface communication port 220 may be complementary to the tool communication port 218. For example, the tool communication port 218 may be a physical port, and the interface communication port 220 may include a complementary, mating physical port. In some embodiments, the tool communication port 218 may be a female port and the interface communication port 220 may be a male port. In some embodiments, the tool communication port 218 may be a male port and the interface communication port 220 may be a female port. In some embodiments, the tool communication port 218 and the interface communication port may communicate wirelessly using the same wireless communication protocol, either in the presence or absence of a physical, mating connector.

Different downhole tools 212 may have different tool communication ports 218. The different ports may be a result of the type of downhole tool, geometry of a particular downhole tool, the time of manufacturing of the downhole tool, the manufacturing location of the downhole tool, any other reason, and combinations thereof. In some embodiments, the downhole tool interface 214 may include a generic interface communication port 220. A generic interface communication port 220 may be interchangeable between different downhole tools, regardless of any changes in the type of tool communication port 218. In some embodiments, a downhole tool interface 214 may include a plurality of tool communication ports 218 designed to connect to different types of tool communication ports 218. By including a universal tool communication port 218 and/or multiple types of tool communication ports 218, the downhole tool interface 214 may be used on many different types of downhole tools. This may increase the versatility of the downhole tool interface 214 and/or improve the ease of connection of the downhole tool interface 214 with the downhole tool.

The downhole tool interface 214 may be connected to the downhole tool 212 in any suitable way. For example, in some embodiments, the downhole tool interface 214 may be threaded into a threaded connection of the downhole tool 212. In some embodiments, the downhole tool interface 214 may be strapped to the outside of the downhole tool 212 using one or more straps or elastic bands. In some embodiments, the downhole tool interface 214 may be adhered to or welded to the inner or outer surface of the downhole tool 212. In some embodiments, the downhole tool interface 214 may be physically connected to the downhole tool through the connection at the tool communication port 218 and the interface communication port 220. In other embodiments, the connection may be virtual and the downhole tool interface 214 may be in sufficient geographic proximity to wirelessly pair with the downhole tool 212.

The downhole tool interface 214 may include local storage or interface storage 222. The interface storage 222 may store the downhole tool information retrieved from the downhole tool 212, or usable to connect to the downhole tool 212. In some embodiments, the interface storage 222 may include long-term, persistent storage. In some embodiments, the interface storage 222 may be a memory cache that is deleted as soon as the downhole tool information is transmitted to a remote server. The interface storage 222 can include a combination of storage, potentially including at least long and short term storage.

According to some embodiments, the downhole tool interface 214 includes a wireless communication system 224. The wireless communication system 224 may transmit the downhole tool information to a remote server and/or receive information from the downhole tool. In some embodiments, the wireless communication system 224 may transmit the downhole tool information directly from the interface communication port 220. Put another way, the wireless communication system 224 may transmit the downhole tool information as soon as it is received, without the downhole tool information being stored in the interface storage 222. In some embodiments, the wireless communication system 224 may transmit the downhole tool information stored in the interface storage 222.

In some embodiments, the wireless communication system 224 may include any type of wireless communication system. For example, the wireless communication system 224 may communicate over Wi-Fi, cellular networks, satellite networks, Bluetooth, Zigbee, Z-wave, 6LowPAN, Thread, Sigfox, Neul, LoRaWAN, infrared, any other wireless communication system, and combinations thereof. In some embodiments, the wireless communication system 224 may communicate over multiple communication systems, depending on the availability of signals and networks. Wellbores can be located at remote locations where cellular networks are not established and/or where satellite signals may not reliably reach. Communicating over multiple types of wireless communication systems may allow the downhole tool interface 214 to communicate the downhole tool information to a drilling operator in a variety of scenarios.

In some embodiments, the wireless communication system 224 may communicate with a remote server or computing device. In some embodiments, the remote computing device may be a server or other computing device located at a drill site. For example, the downhole tool 212 may be retrieved from a wellbore and physically and/or wirelessly connected to the downhole tool interface 214. The downhole tool interface 214 may retrieve downhole tool information and transmit the retrieved downhole tool information to the on-site computing device over Wi-Fi or another protocol. This may allow the drilling operator to quickly analyze the collected downhole tool information on-site, and make any changes or updates to the wellbore or operational plan that may be inferred from the downhole tool information. In some embodiments, the downhole tool interface 214 may transmit the retrieved downhole tool information to any other computing device or server, such as a cloud server, a corporate server, a personal computing device, any other computing device, and combinations thereof. For purposes of this disclosure, an on-site computing system can also be considered a remote computing system when physically separated from the downhole tool interface 214.

In some embodiments, the wireless communication system 224 may transmit the downhole information when a particular type of communication system is available. For example, the wireless communication system 224 may transmit the downhole information over Wi-Fi when a known Wi-Fi network is detected. In some examples, the wireless communication system 224 may transmit the downhole information over a cellular network with the cellular network is detected, over a mesh network when a known mesh network is detected, and the like.

In some embodiments, the wireless communication system 224 may transmit the downhole information as soon as the downhole information is retrieved and/or as soon as the wireless communication system 224 connects to a network or device. In some embodiments, the wireless communication system 224 may transmit the downhole information upon receiving a request from a remote computing device. In some embodiments, the request from the remote computing device may include a particular communication protocol. When the downhole tool interface 214 receives the request for the downhole information, the wireless communication system 224 may transmit the downhole information over the requested communication system and/or any available wireless communication system.

Transmitting the downhole information wirelessly may make accessing the downhole information easier and faster. Conventionally, a specially trained engineer or technician may access the downhole tool and retrieve the downhole information directly from the downhole tool. By communicating the downhole tool information to a remote computing device, an engineer or other technician may not be needed on site, thereby reducing the overall cost of a wellbore. Furthermore, wirelessly transmitting the downhole information may allow the downhole tool interface 214 to retrieve the information from the downhole tool 212 at the transmission speed available to the downhole tool 212. Some downhole tools 212 may have slow transmission speeds. The downhole tool interface 214 may be connected to the downhole tool 212 during storage and/or transit. The downtime during storage and/or transit may allow sufficient time to retrieve all of the stored downhole information. In this manner, an engineer or other technician may not need to be on-site the entire time the information is downloading.

In some embodiments, the downhole tool interface 214 may include one or more wired communication interfaces. Optionally, the wired communication interface can be used when wireless communication is unavailable or undesirable.

In accordance with embodiments of the present disclosure, the downhole tool interface 214 may include an interface power source 226. The interface power source 226 may provide operating power to the components of the downhole tool interface 214. For example, the interface power source 226 may provide operating power to one or more of the interface communication port 220, the interface storage 222, the wireless communication system 224, or any other powered element of the downhole tool interface 214. Using the interface power source 226, the downhole tool interface 214 may be independent of the downhole tool 212, and may supply its own power.

In some embodiments, the interface power source 226 may be a battery or other energy storage device. In some embodiments, the battery may be charged at a drill site and may include sufficient charge to retrieve downhole information from the downhole tool 212 and transmit that information to the remote computing device. In some embodiments, the battery may include sufficient charge to power one or more status sensors, memory, or communication ports located on the downhole tool interface 214 and communicate those sensor readings to the remote device, as will be discussed in further detail herein.

In some embodiments, the interface power source 226 may include a power generation system. The power generation system may include any power generator that may allow the downhole tool interface 214 to operate. In some embodiments, the power generation system may include a kinetic power generator. In some embodiments, a kinetic power generator utilizes movements of the downhole tool interface 214 to agitate or otherwise move a magnetic element within electrical coils. The movement of the magnetic element may cause an electric current to be developed in the electrical coils. The electric current may then be used to operate the electric components of the downhole tool interface 214 and/or charge a battery. Transportation and/or handling of the connected downhole tool 212 and the downhole tool interface 214 may naturally include motions that may be harvested by the kinetic power generator, including vibrations, bumps, jostles, and so forth. In this manner, the downhole tool interface 214 may have a readily available power supply based on known shipping, handling, and other motions that the downhole tool 212 and connected downhole tool interface 214 may experience. This may help to improve the reliability of the downhole tool interface by making it potentially independent of any other power source.

In some embodiments, the interface power source 226 may include any other power generator, including solar power panels, a fossil fuel power generator, any other power generator, and combinations thereof. In some embodiments, a battery of the interface power source 226 may be charged using multiple mechanisms, such as an on-board power generator while also allowing connection to an external power source. Charging the battery using an external power source may help to maintain the charge on the battery when not in use, such as when a downhole tool 212 is being used downhole and/or when the downhole tool 212 and/or downhole tool interface 214 is in storage.

In some embodiments, when connected, the interface power source 226 of the downhole tool interface 214 may be connected to a tool power source 228 of the downhole tool 212 by using a power connection 230. For example, the interface communication port 220 and the tool communication port 218 may be connected with a powered connection. In some examples, the interface communication port 220 may include power contacts that are physically complementary to power contacts on the tool communication port 218. In some examples, the downhole tool 212 and the downhole tool interface 214 may have a power connection 230 that is separate from the interface communication port 220 and the tool communication port 218. In some embodiments, a wireless power connection is used between the downhole tool 212 and the downhole tool interface 214.

In some embodiments, the tool power source 228 may provide power to the downhole tool interface 214, such as through the interface power source 226 over the power connection 230 or by charging the interface power source 226. In some embodiments, the tool power source 228 may directly power elements of the downhole tool interface 214 without power being routed through the interface power source 226. In this manner, the tool power source 228 may be a supplementary power source to the interface power source 226. In some embodiments, this may help to ensure that the interface power source 226 has sufficient power for the downhole tool interface to perform its functions, including retrieving the downhole information from the downhole tool 212, transmitting the downhole information from the downhole tool 212, collecting environment information from status sensors, and so forth.

In some embodiments, the interface power source 226 may provide power to the elements of the downhole tool 212 over the power connection 230. For example, the interface power source 226 may provide power and/or charge to the tool power source 228. In some embodiments, the tool power source 228 may be completely discharged and/or have insufficient power to transmit the downhole information from the downhole tool memory 216 to the downhole tool interface 214. The downhole tool interface 214 may provide power to the downhole tool 212 through the interface power source 226 so that the downhole tool 212 may transmit the downhole information to the downhole tool interface 214.

In some embodiments, the downhole tool interface 214 may provide sufficient power to the downhole tool 212 for the downhole tool 212 to operate in an operational mode. This may fully power up any processors on the downhole tool 212 to help in retrieval of the downhole information. In some embodiments, the downhole tool interface 214 may provide sufficient power to the downhole tool 212 for the downhole tool 212 to operate in a data retrieval mode. The data retrieval mode may be a low-power mode where the processors and downhole tool memory 216 receive enough power to transmit the downhole information to the downhole tool interface. Downhole tools 212 may have large power usage rates, and a data retrieval mode may allow the downhole tool interface 214 to retrieve the downhole information without overly draining one or both of the interface power source 226 or the tool power source 228. In should be understood that the data retrieval mode may be powered by one or both of the interface power source 226 or the tool power source 228.

In some embodiments, each downhole tool 212 may have a unique tool identification (e.g., a tool ID). The tool ID may include or be associated with information about the downhole tool 212, including identification information, tool type, tool location, tool size, tool usage rate, tool itinerary, tool communication protocols, any other tool information, and combinations thereof. The tool ID may be used to track the location of the tool, plan maintenance for the tool based on usage data, assign the tool to a particular wellbore or job, and so forth. In some cases, the tool ID may be specific to a class of tools rather than a particular tool, and used to provide general information for that class of tool, including the tool type, tool size, tool communication protocol, etc.

As discussed herein, in some embodiments, the downhole tool interface 214 may be connectable to a plurality of different downhole tools 212. When the downhole tool interface 214 is connected to a particular downhole tool 212, the downhole tool interface 214 may query the downhole tool for the tool ID. When the downhole tool interface 214 transmits downhole drilling, production, environmental, or other information about or from the downhole tool, the downhole tool interface 214 may transmit the associated tool ID. In this manner, by being connectable to multiple types of downhole tools, the downhole tool interface 214 may be swapped out at the surface without worrying about matching specific downhole tool interfaces 214 to a particular downhole tool 212. This may improve the versatility of the downhole tool interface and/or reduce the chance of downhole information being associated with the wrong tool.

In some embodiments, the downhole tool interface 214 may facilitate two-way communication with the downhole tool 212. For example, as discussed herein, the downhole tool interface 214 may retrieve downhole information from the downhole tool 212. In some embodiments, the downhole tool interface 214 may transmit information to the downhole tool 212. For example, the downhole tool interface 214 may wirelessly receive instructions using the wireless communication system 224. The instructions may then be transmitted to the downhole tool 212. In some embodiments, such instructions may include survey instructions, trajectory information, power generation and usage instructions, software updates and patches, and so forth. Wirelessly transmitting the instructions or other information to the downhole tool interface 214 and then having the downhole tool interface 214 transmit the instructions to the downhole tool 212 may help to improve the efficiency of planning and operation of the wellbore by reducing the amount of information that is manually transmitted to the downhole tool 212.

Figure 3:
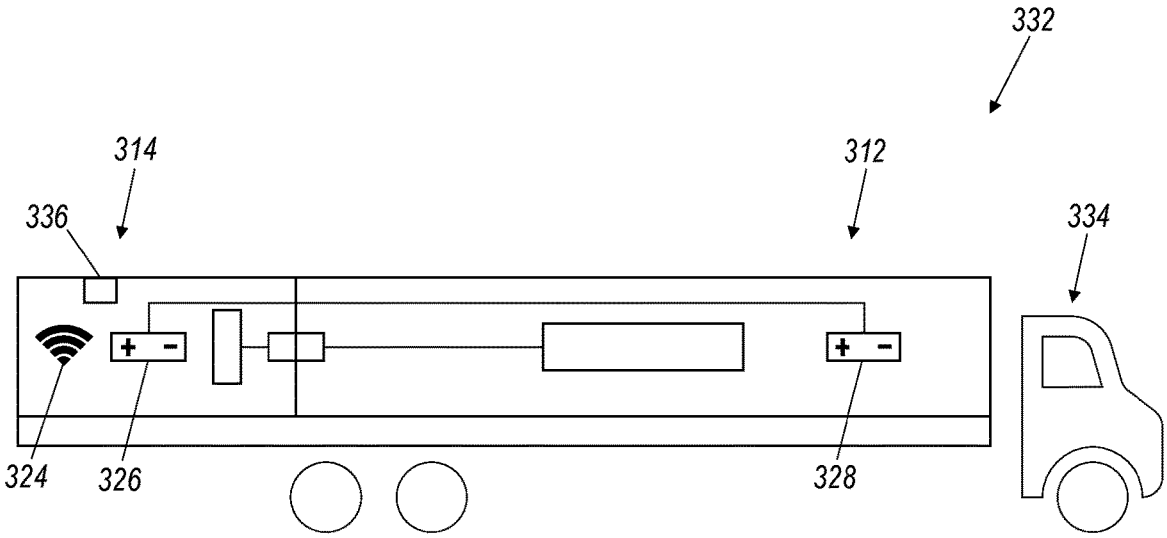
FIG. 3 is a representation of a downhole tool transportation system, according to at least one embodiment of the present disclosure.

FIG. 3 is a representation of a downhole tool transportation system 332 in which a downhole tool 312 coupled to a downhole tool interface 314 is being transported on a vehicle, which is illustrated as a truck 334, according to at least one embodiment of the present disclosure. Downhole tools 312 are often used at many different wellbores during their lifetime. The different wellbores may be located remotely from each other, including by thousands of miles. Downhole tools are often transported to the different wellbores using trucks 334, by air or train, or by using other highway, rail, or other transportation mechanisms.

In some embodiments, the downhole tool interface 314 may remain connected to the downhole tool 312 during all or a portion of the storage and/or transportation between wellbores (or between a wellbore and a maintenance or storage facility). In some embodiments, the downhole tool interface 314 may retrieve downhole information from the downhole tool 312 during storage and/or transportation. In some embodiments, the downhole tool interface 314 may transmit the downhole drilling formation to a remote computing device during storage and/or transportation using the wireless communication system 324. As discussed herein, transportation may result in motion that may harvested by a kinetic power generation system, which may be part of an interface power source 326. In some embodiments, motion during transportation may be sufficient that kinetic power generation system may charge a battery of the tool power source 328 and/or the interface power source 326. In some embodiments, the battery on the tool power source 328 may be charged to capacity such that the downhole tool 312 is ready to immediately begin operation when it enters a wellbore, thereby saving time and downhole power resources from charging the tool power source 328 downhole or at the rig site.

In some embodiments, the downhole tool interface 314 may include one or more status sensors 336. Optionally, status sensors 336 may be located on the downhole tool 312. The status sensor(s) 336, wherever located, may collect status and/or environmental data regarding the conditions of use, shipping, or transportation of the downhole tool 312. The status sensor 336 may include any type of sensor, including a location sensor (e.g., GPS sensor), an accelerometer, a vibration sensor, a temperature sensor, a moisture sensor, a force sensor any other type of sensor, and combinations thereof. Using the data collected by the status sensor 336, a drilling operator may determine the conditions during use, storage, or transportation of the downhole tool 312. In some embodiments, the status sensors 336 may determine or collect information about a tool status of the downhole tool 312. In some embodiments, the tool status may include location, movement history (e.g., acceleration speed, drop history), vibration information, environmental conditions (e.g., temperature, humidity), any other tool status, and combinations thereof.

In some embodiments, the drilling operator may use the use, storage, and transportation information for any purpose. For example, the drilling operator may use location information to identify and/or verify a location of the downhole tool 312. This may help to improve inventory management by reducing the chance that a particular downhole tool 312 may be lost. This may further help to optimize resource usage, because the drilling operator may assign a downhole tool that is closest to a particular wellbore to perform a particular job, thereby reducing shipping time and cost.

In some embodiments, the drilling operator may use the use, storage, and transportation information to identify or infer the source of damage to a downhole tool 312. For example, vibration and/or accelerometer information may help to determine if a downhole tool 312 was dropped during loading and/or unloading, thereby causing shock damage to the downhole tool 312. In some examples, force sensor information may help to identify if too much weight was placed on the downhole tool 312, such as by stacking too many items on the downhole tool 312 during storage. In some examples, temperature and moisture information may help to identify the cause of shorts in electronic components of the downhole tool 312. In some embodiments, identifying the source of damage to the downhole tool 312 may help to assign liability for the damage, and may help to resolve dispute regarding liability for the damage.

Figure 4:
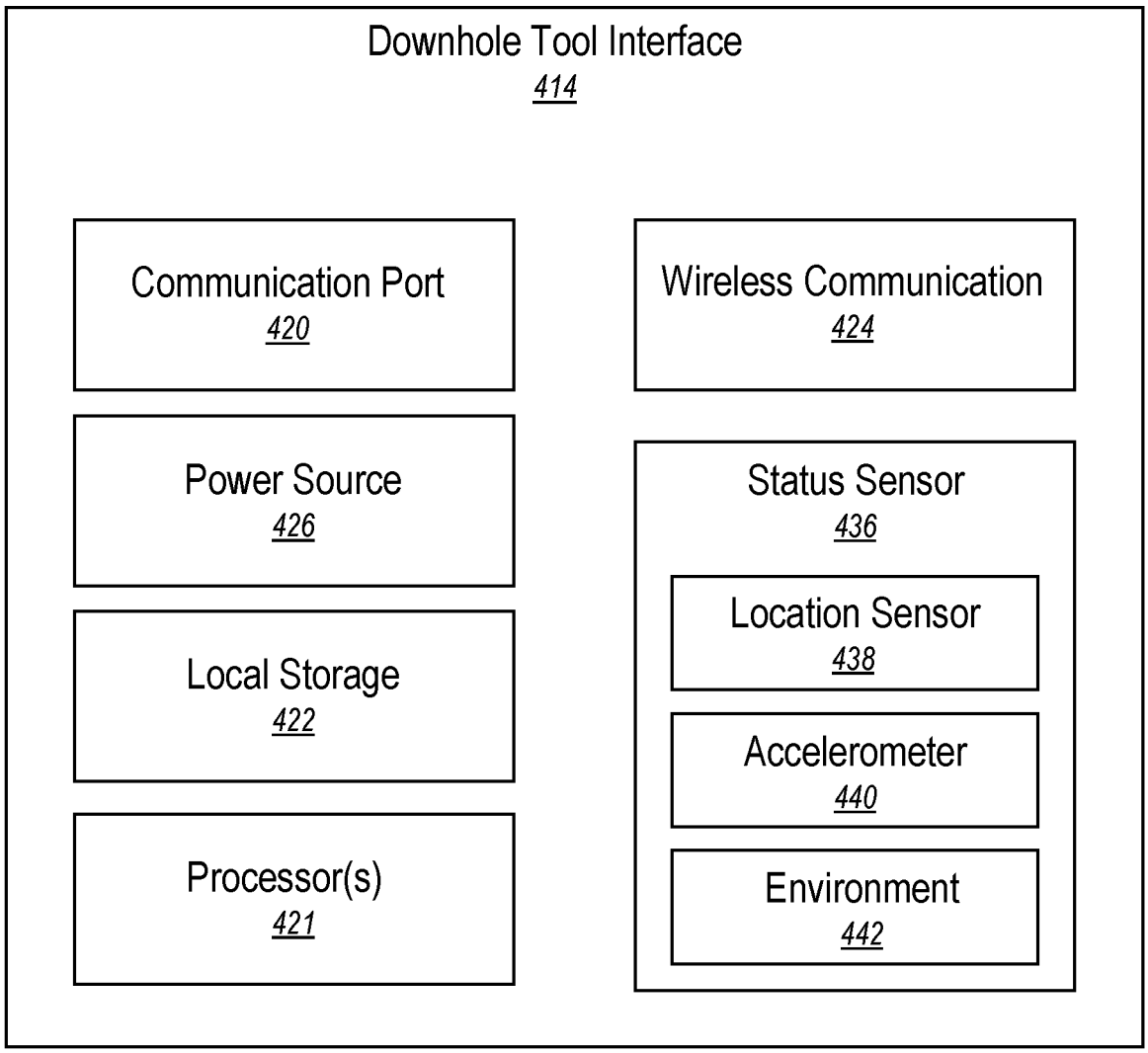
FIG. 4 is a representation of a downhole tool interface, according to at least one embodiment of the present disclosure.

FIG. 4 is a representation of a downhole tool interface 414, according to at least one embodiment of the present disclosure. The downhole tool interface 414 may include one or more processors 421. The one or more processors 421 may be in communication with various hardware and software systems. The downhole tool interface 414 may include memory (e.g., in local storage 422) having instructions which, when accessed by the one or more processors 421, cause the one or more processors 421 to perform certain operations, as discussed in further detail herein.

The downhole tool interface 414 may include a communication port 420. The communication port 420 may be configured to interface with a physical or wireless downhole tool communication port (e.g., the tool communication port 218 of FIG. 2). The communication port 420 may be configured to request and receive information from the downhole tool, including the tool ID, downhole information, and so forth. In some embodiments, the communication port 420 may be configured to transmit information to the downhole tool, including operating and other instructions.

The downhole tool interface 414 may include a power source 426. The power source 426 may provide power to the various elements of the downhole tool interface 414. As discussed herein, in some embodiments, the power source 426 may include a power generation system, such as a kinetic power generator. In some embodiments, the power source 426 may provide power to the power source of the downhole tool.

The downhole tool interface 414 may include local storage 422. The local storage 422 may be local memory, and may store one or more of the retrieved downhole information, tool instructions for transmission to the downhole tool, or instructions for the one or more processors 421. The downhole tool interface 414 may further include a wireless communication system 424. The wireless communication system 424 may transmit and or receive wireless messages from a remote computing device or the downhole tool. In some embodiments, the wireless communication system 424 may transmit the retrieved downhole information stored in the local storage 422.

The downhole tool interface 414 may further include one or more status sensors 436. The status sensors 436 may be used to determine the status of the downhole tool interface 414 and/or the connected downhole tool. The status sensors 436 may include a GPS or other location sensor 438, an accelerometer 440, an environment sensor 442, any other status sensor 436, or combinations thereof.

Figure 5:
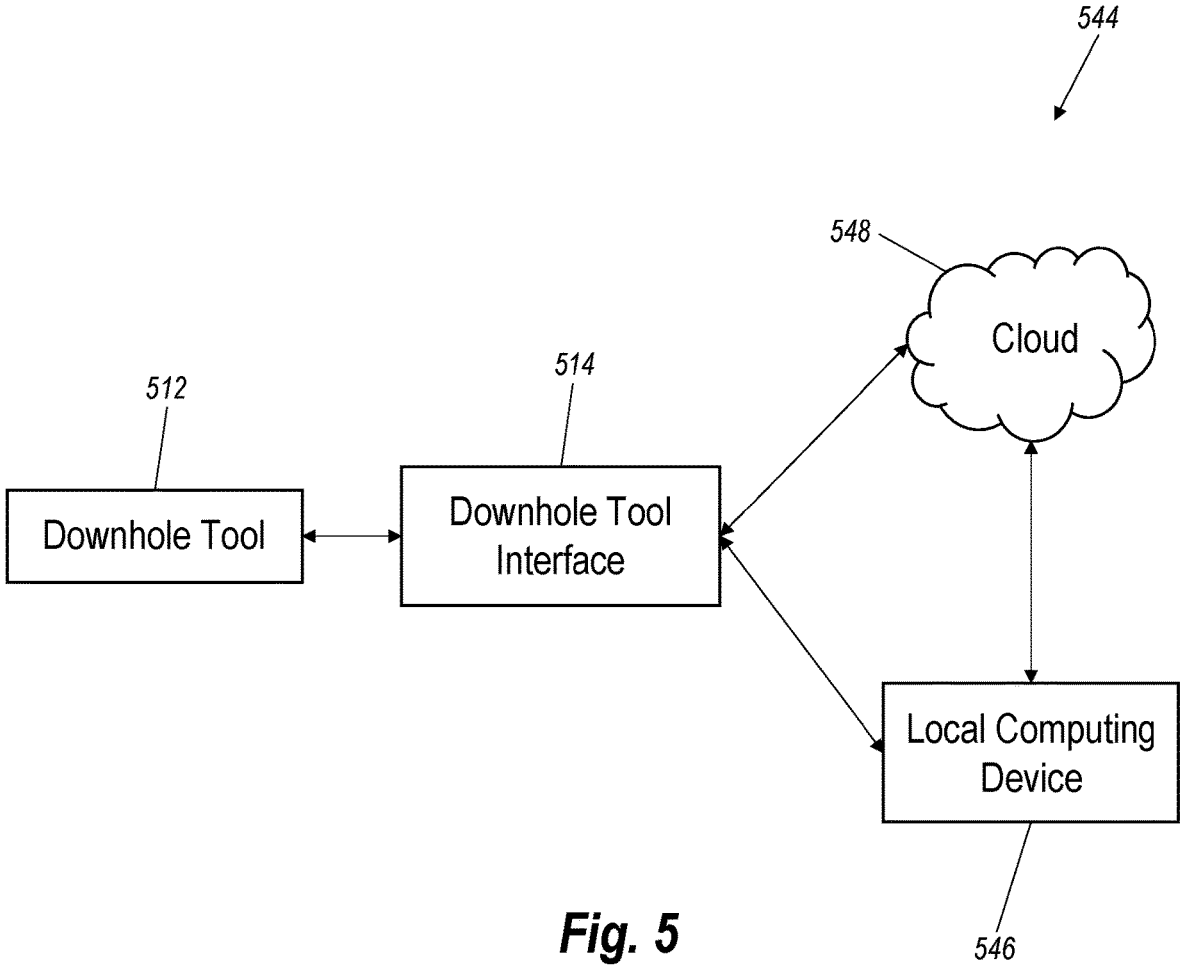
FIG. 5 is a representation of a downhole tool tracking network, according to at least one embodiment of the present disclosure.

FIG. 5 is a schematic of a downhole tool tracking network 544, according to at least one embodiment of the present disclosure. The tracking network 544 includes a downhole tool 512 connected to a downhole tool interface 514. The downhole tool interface 514 may be in power and/or data communication with the downhole tool 512. The downhole tool interface 514 may retrieve downhole information (e.g., downhole drilling information) from the downhole tool 512 and/or transmit instructions or information to the downhole tool 512.

The downhole tool interface 514 may then transmit the downhole information from the downhole tool 512 to a remote computing device. For example, the downhole tool interface 514 may transmit the downhole information to a local computing device 546 located at or near a drill rig. In some examples, the downhole tool interface 514 may transmit the downhole information to a remote server, such as a cloud network 548. In some embodiments, a drilling operator at the local computing device 546 or accessing the cloud network 548 may analyze the downhole information and provide recommendations for the downhole tool 512, including maintenance plans, operational plans, wellbore location, and so forth.

In some embodiments, the drilling operator may upload the downhole information from the local computing device 546 to the cloud network 548. In some embodiments, the drilling operator may further receive instructions or other information to be transmitted to the downhole tool 512 through the downhole tool interface 514. In some embodiments, the drilling operator may transmit this information to the downhole tool interface 514 from the local computing device 546. In some embodiments, the drilling operator may transmit this information to the downhole tool interface 514 from the cloud network 548.

In accordance with embodiments of the present disclosure, the downhole tool tracking network 544 may improve the tracking and management of the downhole tool 512. Downhole information retrieval and transmission by the downhole tool interface 514 may be swift and not utilize any specially trained personnel. In some embodiments, location and status information may help with inventory management, thereby improving the efficiency of downhole drilling operations.

Figure 6:
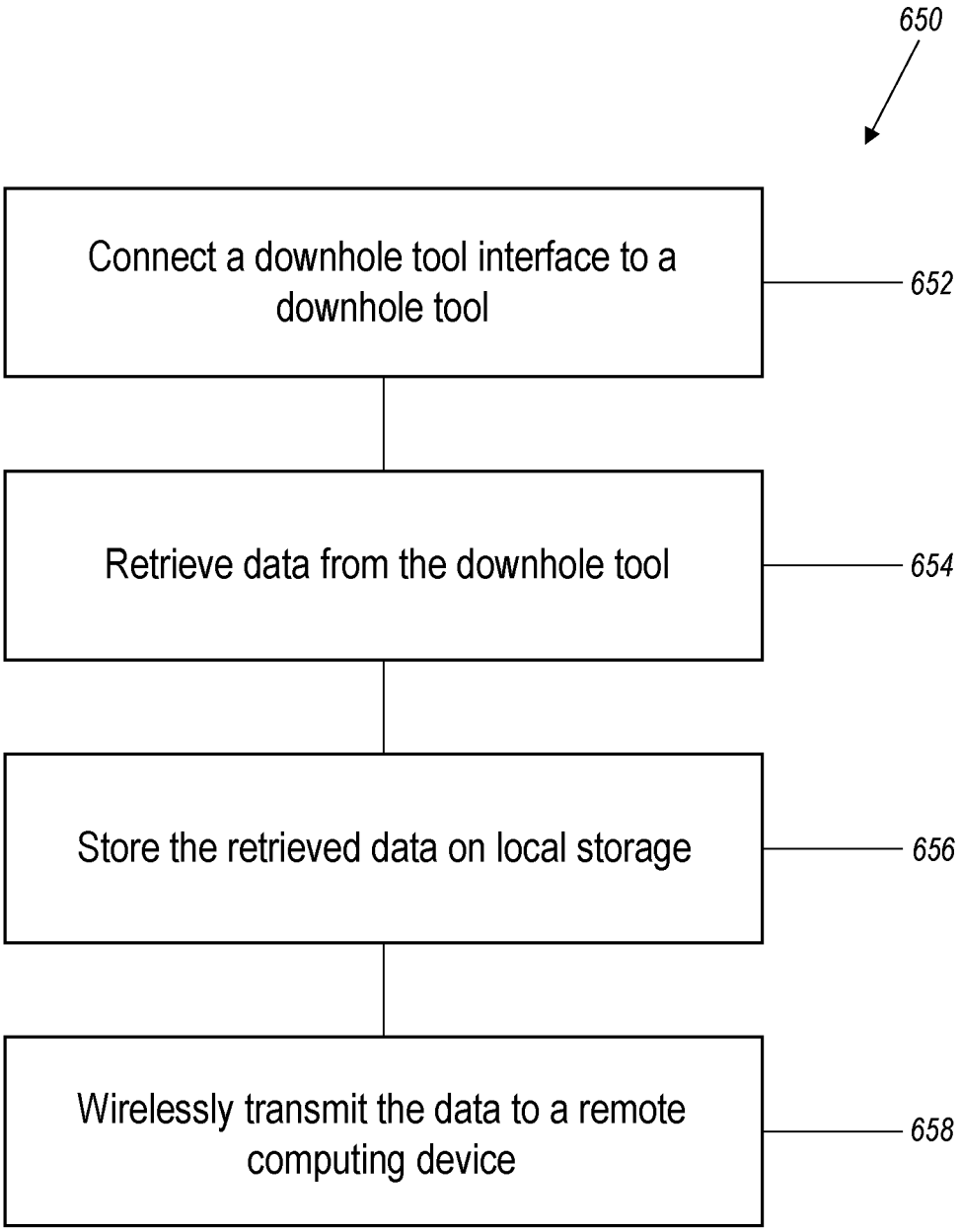
FIG. 6 is a flowchart of a method for collecting data from a downhole tool, according to at least one embodiment of the present disclosure.

FIG. 6 is a flowchart of a method 650 for collecting data from a downhole tool at a surface location, according to at least one embodiment of the present disclosure. The method 650 may include connecting a downhole tool interface to a downhole tool at 652. The downhole tool interface may be connected to the downhole tool over a communication interface. For example, the communication interface may be a high-speed communication interface, capable of data transfer rates of up to 1 megabyte per second (MBPS), 10 MBPS, 100 MBPS, 1 gigabyte per second (GBPS), 10 GBPS, 100 GBPS, or faster.

After the downhole tool interface is connected, the data may be retrieved from the downhole tool at 654. In some embodiments, retrieving the data may include retrieving the data stored locally on the downhole tool. In some embodiments, the retrieved data may be stored locally on local storage at 656. The retrieved and/or stored data may then be wirelessly transmitted to a remote computing device at 658.

In some embodiments, the method 650 may further include providing power to the downhole tool using an interface power source located on the downhole tool interface. In some embodiments, providing power to the downhole tool may include providing power for a data retrieval mode, or low-power mode, of the downhole tool. The downhole tool interface may place the downhole tool in the data retrieval mode, and the downhole tool may retrieve the data from the downhole tool when the downhole tool is in the data retrieval mode.

In some embodiments, the method 650 may further include receiving power from the downhole tool using the interface power source located on the downhole tool interface. In some embodiments, receiving power from the downhole tool may include receiving power for a data retrieval mode, or low-power mode, of the downhole tool interface.

In some embodiments, the method 650 may further include retrieving and/or transmitting the data during storage and/or transportation of the downhole tool. The data may be retrieved from the downhole tool or a remote computing device and transmitted to the downhole tool or the remote computing device. In some embodiments, the downhole tool may be stored and/or transported while the downhole tool interface is connected to the downhole tool.

The embodiments of the downhole tool interface have been primarily described with reference to wellbore drilling operations; however, the downhole tool interface described herein may be used in applications other than the drilling of a wellbore. In other embodiments, downhole tool interfaces according to the present disclosure may be used outside a wellbore or other downhole environment used for the exploration or production of natural resources. For instance, downhole tool interfaces of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole tool interface for monitoring status of a downhole tool during shipping and handling of the downhole tool, the downhole tool interface comprising:

a housing containing a communication port, a wireless communication system, and a plurality of status sensors;

wherein the communication port is operative to connect to the downhole tool at one or more surface locations during shipping and handling of the downhole tool and retrieve data from the downhole tool;

wherein the wireless communication system is configured to communicate wirelessly with a remote computing device; and wherein the plurality of status sensors is configured to sense the status of the downhole tool while the downhole tool is at the one or more surface locations during shipping and handling of the downhole tool in order to track location and conditions of the downhole tool while the downhole tool is at the one or more surface locations during shipping and handling of the downhole tool.

2. The downhole tool interface of claim 1, wherein the plurality of status sensors includes a location sensor.

3. The downhole tool interface of claim 1, wherein the plurality of status sensors includes an accelerometer.

4. The downhole tool interface of claim 1, wherein the communication port is interchangeable for connection to a plurality of downhole tools.

5. The downhole tool interface of claim 1, wherein:

the plurality of status sensors includes at least one sensor selected from the group consisting of a GPS sensor, an accelerometer, a vibration sensor, a temperature sensor, a moisture sensor, and a force sensor.

6. The downhole tool interface of claim 1, wherein:

the housing further contains local data storage configured to store information communicated by the downhole tool and retrieved from the communication port.

7. The downhole tool interface of claim 1, wherein the wireless communication system is operative to wirelessly connect to a cellular network.

8. The downhole tool interface of claim 1, wherein the wireless communication system is operative to wirelessly connect to a satellite network.

9. The downhole tool interface of claim 1, wherein the housing is configured for use in a hazardous environment.

10. The downhole tool interface of claim 1, wherein the housing further contains a power source.

11. The downhole tool interface of claim 10, wherein the power source includes a battery.

12. The downhole tool interface of claim 10, wherein the power source includes a kinetic power generator.

13. The downhole tool interface of claim 10, further comprising a power connection between the power source and the downhole tool.

14. A method for monitoring status of a downhole tool during shipping and handling of the downhole tool, comprising:

connecting a downhole tool interface to the downhole tool at one or more surface locations during shipping and handling of the downhole tool;

retrieving data from the downhole tool over a communication port of the downhole tool interface;

storing the data on local storage of the downhole tool interface;

wirelessly transmitting the data to a remote computing device; and using a plurality of status sensors of the downhole tool interface to sense the status of the downhole tool while the downhole tool is at the one or more surface locations during shipping and handling of the downhole tool.

15. The method of claim 14, further comprising providing power to the downhole tool.

16. The method of claim 15, wherein providing power to the downhole tool includes powering a data retrieval mode of the downhole tool, and wherein retrieving the data from the downhole tool includes retrieving the data when the downhole tool is in the data retrieval mode.

17. The method of claim 14, wherein retrieving the data includes retrieving information stored locally on the downhole tool.

18. The method of claim 14, further comprising generating power for the downhole tool interface using a power generator.

19. The method of claim 14, wherein retrieving the data includes retrieving a tool identifier for the downhole tool.

20. The method of claim 14, further comprising:

configuring the downhole tool interface to track location and conditions of the downhole tool while the downhole tool is at the one or more surface locations during shipping and handling of the downhole tool based on the status sensed by the plurality of status sensors.

* * * * *